United States Patent [19]

Rushing et al.

[11] Patent Number: 5,075,725

[45] Date of Patent: Dec. 24, 1991

[54] AUTOMATIC SET-UP FOR ELECTROSTATOGRAPHIC MACHINES

[75] Inventors: Allen J. Rushing, Webster; Brian D. McLean, Spencerport, both of N.Y.

[73] Assignee: Eastman Kodak Company, Rochester, N.Y.

[21] Appl. No.: 678,396

[22] Filed: Apr. 1, 1991

[51] Int. Cl.[5] ..... G03G 15/00; G03G 15/01

[52] U.S. Cl. ..... 355/208; 355/214; 355/246; 355/327

[58] Field of Search ..... 355/207, 208, 214, 246, 355/326, 327

[56] References Cited

U.S. PATENT DOCUMENTS

| | | | |
|---|---|---|---|
| 4,350,435 | 9/1982 | Fiske et al. | 355/246 |
| 4,451,137 | 5/1984 | Farley | 355/246 |
| 4,647,184 | 3/1987 | Russell et al. | 355/208 |
| 4,853,738 | 8/1989 | Rushing | 355/327 |
| 4,888,636 | 12/1989 | Abe | 355/326 X |
| 4,894,685 | 1/1990 | Shoji | 355/246 |
| 4,949,135 | 8/1990 | Ng | 355/327 |

*Primary Examiner*—Joan H. Pendegrass
*Attorney, Agent, or Firm*—Milton S. Sales

[57] ABSTRACT

An automatic set-up procedure uses a special set-up target document on the platen to compensate for changes in toning by adjusting process control parameters for neutrality and density. The target document has a neutral density step tablet which is imaged onto the recording member in the track of an on-line densitometer. Process control parameter adjustments are computed on-line based on deviations of measured densities from stored values corresponding to an aim print. Density aim values corresponding to a good print may need to be slightly different from machine to machine, and according to customer preferences. The aim values may have to be updated as the machine ages. Determination of the density aim values involves a manual calibration procedure, at the end of which, a new set of density aim values are stored for subsequent use in automatic set-up procedures.

24 Claims, 3 Drawing Sheets

AUTOMATIC SET-UP FOR ELECTROSTATOGRAPHIC MACHINES

BACKGROUND OF THE INVENTION

1. Field of the Invention

The invention relates to color electrostatographic document production machines, and more particularly to automatic adjustment of parameters influencing the output copy color balance, color fidelity, and tone reproduction of such machines.

2. Description of the Prior Art

In electrostatographic document production machines such as printers and copiers, image contrast, density, and color balance can be adjusted by changing certain process control parameters. Such parameters most frequently include primary voltage $V_0$, exposure $E_0$, and development station electrode bias voltage $V_b$. Other process control parameters which are less frequently used, but which are effective to control the image contrast, density, and color balance include the concentration of toner in the developer mixture, and the image transfer potential.

Techniques exist for regulating electrostatographic machine process control parameters so as to compensate for long term variations in the electrostatographic process. The phrase "long term" pertains to variations which would affect many successive images, and includes variations caused by such things as changes in toner concentration, wear of the image transfer member, aging of the exposure lamp, and atmospheric conditions.

Prior art systems attempt to diminish the adverse effects of these variations using manual or automatic set-up systems, or a combination of both. In typical manual set-up systems, a skilled operator examines the output reproduction (copy or print) and the corresponding input and output density ($D_{in}$-$D_{out}$) curves for red, green, blue, and black. Based on experience with the equipment, the operator determines adjustments to process control parameters, such as initial voltage $V_0$, exposure $E_0$, and development bias $V_b$. Several iterations of adjustment may be required to achieve acceptable color reproductions, in terms of color balance, color fidelity, and tone reproduction.

During set-up, a skilled operator will generally image a neutral density step tablet and adjust the process for hue neutrality of the reproduction. After achieving reasonable neutrality, the operator will adjust for good tone reproduction (i.e., good light-to-dark progression, contrast, and absence of abrupt density changes between density steps). Finally, the operator will check and adjust for neutrality again, all this in an iterative procedure until satisfied with the overall resultant reproduction quality.

U.S. Pat. No. 4,894,685, issued Jan. 16, 1990 to Shoji, discloses a method for setting color process control parameters by forming a plurality of different density patches in a non-transfer portion of a photoconductor. Process control parameters are set in accordance with the differences between the recorded densities and "ideal case" densities referred to herein as "aim" densities. U.S. Pat. No. 4,647,184, issued Mar. 3, 1987 to Russell et al., relates to a set-up mode wherein test patches of varying density are compared to stored values. The operating process control parameters of charge, developer bias, and exposure are adjusted in an iterative process until there is convergence along three separate points of a stored aim curve of the photoconductor response to exposure.

Neither patent provides for field adjustments of the values of the aim points. Nor is the operator given the option to revert to the original set-up if desired. Further, there is no provision for producing prints of the toned patches, or for conserving consumables by delaying a print until all iterations are finished.

SUMMARY OF THE INVENTION

Conventionally, "aim" densities for test patches are determined by the manufacturer and programmed into the machine logic. In the present invention, a trained service representative or skilled operator can manually adjust process control parameters until a visually desirable image is produced, and then store the attained patch density values of each color separation for later use as "aim" values during an automatic set-up procedure.

During the set-up procedure, a series of toner test patches are produced and density readings from the patches are compared to aim values. Differences are used to make adjustments to the process control parameters. A plurality of iterations are used to obtain convergence. In one embodiment, the operator is given a choice to either save the new process control parameter settings or to return to either the original or the default settings Trained service representatives are able to refine the set-up process by reviewing a printout (i.e., a copy produced by transferring the color separations in register to a receiver, and fusing) of the density patches, while customer operators would generally not benefit from seeing the printout. Thus, the present invention provides two operational modes, one mode for service representatives, wherein the toned density patches are transfered to a carrier sheet, and another mode for customer operators, wherein paper feed is inhibited and the toned density patches are erased from the recording member without transfer. As an additional feature, printouts may be inhibited even for service representatives in all but the last iteration to save supplies.

According to a preferred embodiment of the present invention, an automatic set-up procedure uses a special set-up target document on the platen to compensate for changes in toning by adjusting process control parameters for neutrality and density. The target document has a neutral density step tablet which is imaged onto the recording member in the track of an on-line densitometer.

Process control parameter adjustments are computed on-line based on deviations of measured densities from stored values corresponding to an aim print. Bare (untoned) recording member readings taken during cycle-up and in interframes are used to correct for film wear, scumming, densitometer drift with temperature, and densitometer dusting. Plural readings are taken in each patch and averaged. Several iterations will be made, with the objective of having the last print fall within density tolerances.

Density aim values corresponding to a good print may need to be slightly different from machine to machine, and according to customer preferences. The aim values may have to be updated as the machine ages. Determination of the density aim values involve a manual calibration procedure, at the end of which, a new set of density aim values are stored for subsequent use in automatic set-up procedures.

The invention and its advantages will become more apparent to those skilled in the art from the ensuing detailed description of preferred embodiments.

BRIEF DESCRIPTION OF THE DRAWINGS

The subsequent description of the preferred embodiments of the present invention refers to the attached drawings, wherein.

DESCRIPTION OF THE PREFERRED EMBODIMENT

Figure 1:
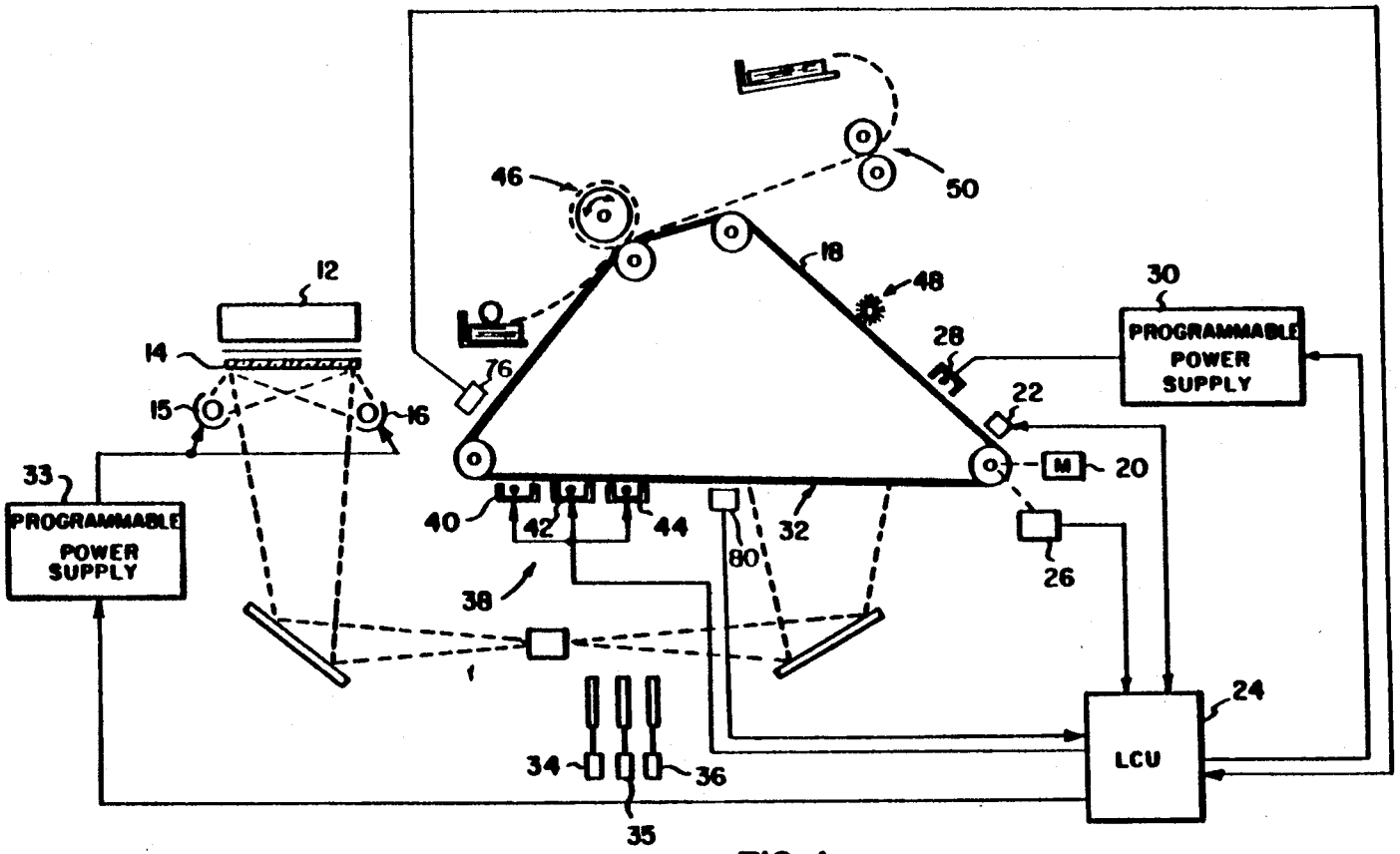
FIG. 1 is a schematic showing a side elevational view of an electrostatographic machine in accordance with the invention.

The present invention is described below in the environment of an electrophotographic copier. At the outset, it will be noted that although this invention is suitable for use with such machines, it also can be used with other types of electrostatographic copiers or printers.

Contrast and Exposure Control

For a detailed explanation of the theory of copier contrast and exposure control by controlling initial voltage, exposure, and bias voltage, reference may be made to the following article: Paxton, Electrophotographic Systems Solid Area Response Model, 22 Photographic Science and Engineering 150 (May/June 1978). To facilitate understanding, the following terms are defined:

$V_b$=Development station electrode bias.

$V_0$=Primary voltage (relative to ground) on the photoconductor just after the charger. This is sometimes referred to as the "initial" voltage.

$V_F$=Photoconductor voltage (relative to ground) just after exposure.

$E_0$=Light produced by the flash lamps.

E=Actual exposure of photoconductor. Light ($E_0$) produced by the flash lamps is reflected off of a portion of a document having a particular density onto the photoconductor and causes a particular level of exposure E of the photoconductor.

Contrast and density control is achieved by the choice of the levels of $V_0$, $E_0$, and $V_b$.

Feeder, Exposure, and Recording Member

A three-color copier includes a recirculating feeder 12 positioned on top of an exposure platen 14. The feeder may be similar to that disclosed in commonly assigned U.S. Pat. No. 4,076,408, issued Feb. 28, 1979, wherein a plurality of originals can be repeatedly fed in succession to the exposure platen.

At exposure platen 14, originals are illuminated by a pair of xenon flashlamps 15 and 16 with a value $E_0$, as described in commonly assigned U.S. Pat. No. 3,998,541, issued Dec. 31, 1976. An image of the illuminated original is optically projected with an exposure value E onto one of a plurality of sequentially spaced, non-overlapping image areas of a moving recording member such as photoconductive belt 18.

Photoconiuctive belt 18 is driven by a motor 20 past a series of work stations of the copier The belt includes timing marks which are sensed, such as by a signal generator 22 to produce timing signals to be sent to a computer controlled logic and control unit (LCU) 24. An encoder 26 also produces timing signals for the LCU. A microprocessor within LCU 24 has a stored program responsive to signals from generator 22 and encoder 26 for sequentially actuating the work stations.

The Work Stations

For a complete description of the work stations, see commonly assigned U.S. Pat. No. 3,914,046. Briefly, a charging station 28 sensitizes photoconductive belt 18 by applying a uniform electrostatic charge of predetermined initial voltage $V_0$ to the surface of the belt. The output of the charger is controllable by a programmable power supply 30, which is in turn controlled by LCU 24 to adjust primary voltage $V_0$. Alternatively, the primary voltage can be set by means of a electroluminescent panel which trims the charge on the photoconductive belt.

The inverse image of the original is projected onto the charged surface of photoconductive belt 18 at an exposure station 32. The image dissipates the electrostatic charge and forms a latent charge image. A programmable power supply 33, under the supervision of LCU 24, controls the value $E_0$ (intensity and/or duration) of light produced by lamps 15 and 16. This, of course, adjusts the exposure E of belt 18, and thereby the voltage $V_F$ of the photoconductor just after exposure. For a specific example of such an exposure station and programmable power supply, see U.S. Pat. No. 4,150,324, issued Aug. 8, 1978.

The illustrated copier is adapted to reproduce three-color copies. The original is illuminated, for example, three times in succession to form three separate latent charge image frames of the original. On successive illuminations, a red filter 34, a green filter 35, or a blue filter 36 is inserted into the light path to form color separation latent charge images at exposure station 32. As understood in the art, provision may be made for a fourth exposure for areas to be developed in black, if desired. The timing of the flash of lamps 15 and 16 and the insertion of filters 34–36 are controlled by LCU 24.

Travel of belt 18 brings the areas bearing the latent charge images into a development area 38. The development area has a plurality of magnetic brush development stations, corresponding to the number of formed color separation images (plus black if used), in juxtaposition to, but spaced from, the travel path of the belt. Magnetic brush development stations are well known; for example, see U.S. Pat. Nos. 4,473,029 to Fritz et al and 4,546,060 to Miskinis et al.

When the color separation images are red, green, and blue, there are three development stations respectively containing complementary colored toner particles, i.e., cyan particles in station 40, magenta particles in station 42 and yellow particles in station 44. The toner particles are agitated in the respective developer stations to exhibit a triboelectric charge of opposite polarity to the latent imagewise charge pattern.

LCU 24 selectively activates the development stations in relation to the passage of the image areas containing corresponding latent color separation images through development area 38 to selectively bring one magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes, and are electrically connected to a variable supply of D.C. potential controlled by LCU 24 for adjusting the development electrode bias voltage $V_b$.

The copier also includes a transfer station 46 and a cleaning station 48, both fully described in commonly assigned U.S. patent application Ser. No. 809,546, filed Dec. 16, 1985. After transfer of the unfixed toner images to a copy sheet, such sheet is transported to a fuser station 50 where the image is fixed to the sheet.

Logic and Control Unit (LCU)

Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

Figure 2:
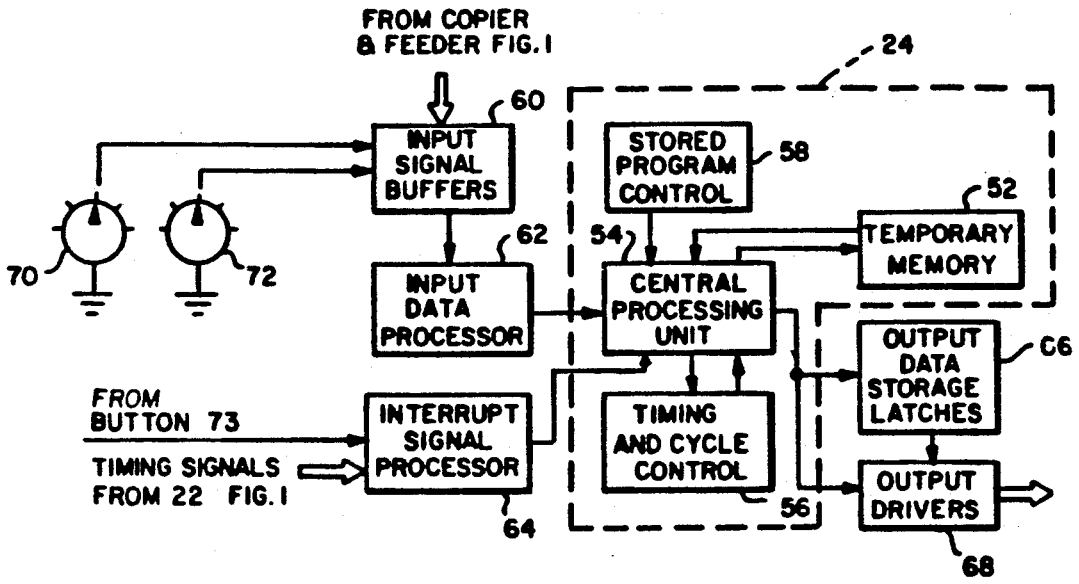
FIG. 2 is a block diagram of the logic and control unit shown in FIG. 1.

Referring to FIG. 2, a block diagram of a typical LCU 24 is shown with interfacing with copier 10 and feeder 12. The LCU consists of temporary data storage memory 52, central processing unit 54, timing and cycle control unit 56, and stored program control 58. Data input and output is performed sequentially under program control Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Calibration of Density Aim Values

Density aim values corresponding to a good print may need to be slightly different from machine to machine, and according to customer preferences. Further, the aim values may have to be updated as the machine ages. Determination of a new set of density aim values involves a manual calibration procedure, at the end of which, a new set of density aim values are stored for subsequent use in automatic set-up procedures.

Information representative of a particular set of machine process control parameters is designated by an exposure knob 70 and a contrast knob 72, which provide inputs to buffers 60. Located in stored program control 58 memory is a matrix array of such sets as described with respect to a black and white copier in the above-identified Fiske et al U.S. Pat. No. 4,350,435. Adaptation to color if desired would readily be accomplished by one of ordinary skill in the art.

Control knobs 70 and 72 settings correspond to a plurality of sets of process control parameters, which in turn correspond to different $D_{in}/D_{out}$ response curves. The first knob 70 functions as an exposure control and translates the break point of the $D_{in}/D_{out}$ curve. When knob 72 is turned, any one of a plurality of different copy contrasts can be designated.

To make single or multiple copies (non-production run condition) of an original and to obtain a copy representative of the conditions designated by the exposure and contrast knobs, a special print copy button on connection 73 must be depressed. The depression of the button causes the copy to be produced in accordance with the $E_0$, $V_0$ and $V_b$ conditions specified by knobs 70 and 72.

A densitometer 76 is provided to monitor development of test patches in image areas of photoconductive belt 18. The densitometer may consist of an infrared light emitting diode (LED) which shines through the belt (transmittance) or is reflected by the belt (reflectance) onto a photodiode. The photodiode generates a voltage proportional to the amount of light- transmitted or reflected from a toned patch.

Figure 3:
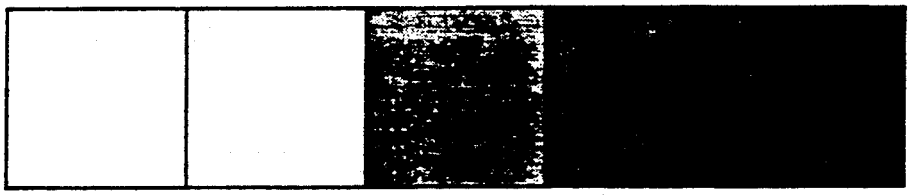
FIG. 3 is an illustration of a neutral density step tablet.

Once the machine has been adjusted for optimal copy quality, a special target document is placed on platen 14. The target document has a plurality, say five, of gray scale patches to form a neutral density step tablet shown in FIG. 3. The target document is imaged onto three frames of photoconductive belt 18 in the track of on-line densitometer 76. Each frame is toned with a different color toner, and the resultant densities are read and stored to form a new set of density aim values for subsequent use in automatic set-up procedures.

Automatic Set-up

The automatic set-up process according to the present invention provides control of the electrostatographic process and to provide "constant" image quality output from the user's perspective The automatic set-up procedure uses the special set-up target document described above to compensate for changes in toning by adjusting process control parameters for neutrality and density. Again, the target document has a five-patch gray scale which is imaged onto the image member in the track of on-line densitometer 76.

Generally, process control parameter adjustments are computed on-line based on deviations of measured densities from stored aim values. Bare (untoned) image member readings taken during cycle-up and in interframes are used to correct for film wear, scumming, densitometer drift with temperature, and densitometer dusting. Four readings are taken in each patch and averaged. Up to eight iterations will be made, with the objective of having the last print fall within density tolerances.

Theory

Assuming that the process control parameters to be adjusted include the primary voltage $V_0$ on the photoconductor surface of belt 18 and the level $E_0$ of main illumination, the imaging process can be characterized by an empirical mathematic model relating output density of each patch in each color separation to $V_0$ and $E_0$ levels. This model is linearized about the nominal operating point so that, for each color separation, the process may be represented by a matrix equation as follows:

$$\begin{vmatrix} \Delta D_1 \\ \Delta D_2 \\ \Delta D_3 \\ \Delta D_4 \\ \Delta D_5 \end{vmatrix} = |A| \begin{vmatrix} \Delta V_0 \\ \Delta E_0 \end{vmatrix}$$

where the delta $\Delta$ denotes deviation from nominal value. This equation may be "solved" for adjustments to $V_0$ and $E_0$ yielding, $$\begin{vmatrix} \Delta V_0 \\ \Delta E_0 \end{vmatrix} = |A^T A|^{-1} A^T \begin{vmatrix} \Delta D_1 \\ \Delta D_2 \\ \Delta D_3 \\ \Delta D_4 \\ \Delta D_5 \end{vmatrix}$$

These adjustments are thus computed according to measured density deviations from the aim values, and will reduce the density deviations so as to minimize the sum of their squares.

To minimize the weighted sum of squared deviations, a diagonal weighting matrix S may be used such that, $$\begin{vmatrix} \Delta V_0 \\ \Delta E_0 \end{vmatrix} = |A^T S A|^{-1} A^T S \begin{vmatrix} \Delta D_1 \\ \Delta D_2 \\ \Delta D_3 \\ \Delta D_4 \\ \Delta D_5 \end{vmatrix}$$

Operation

Figure 4:
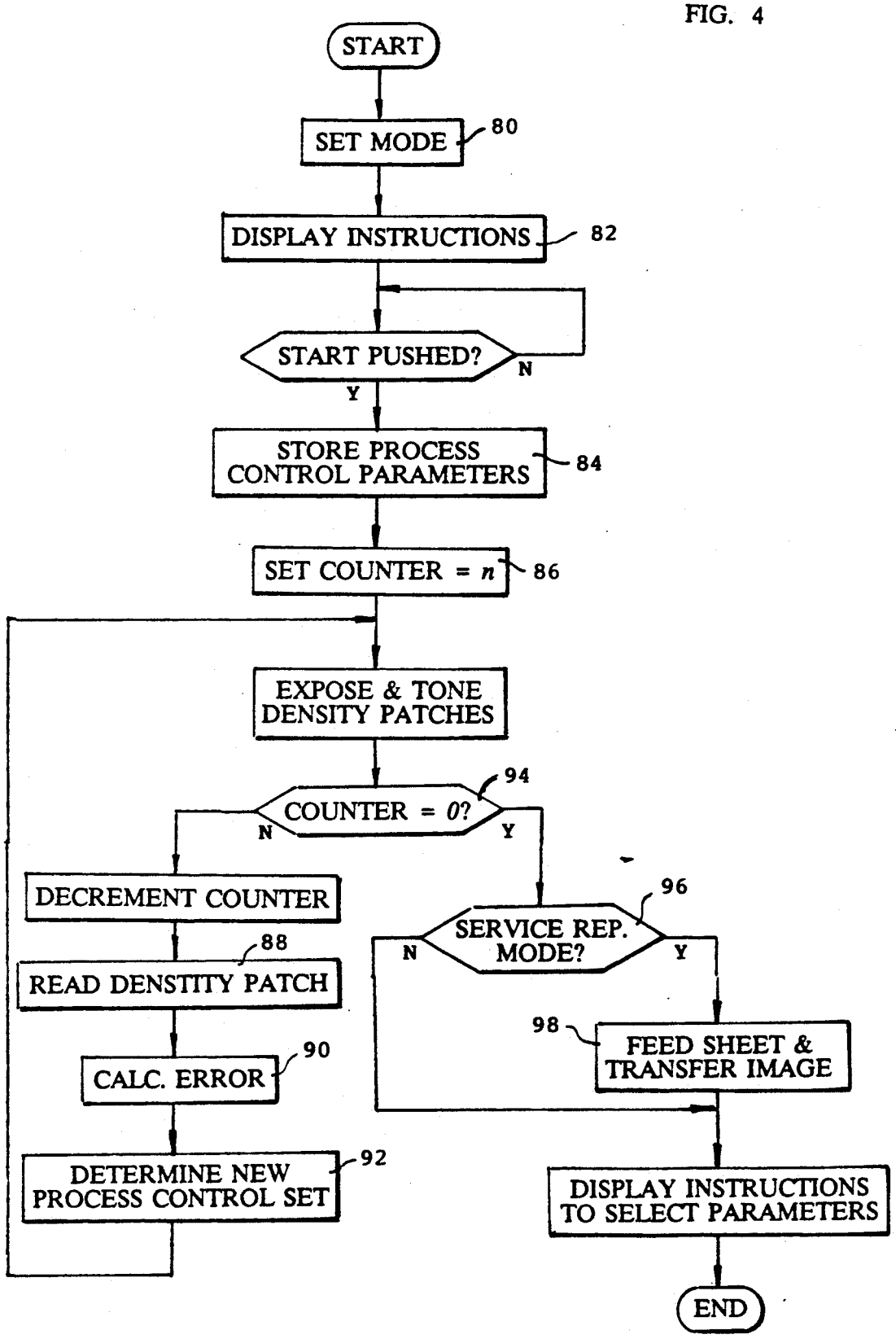
FIG. 4 is a logic flow chart of the operation of the set-up procedure according to the present invention.

Referring to FIG. 4, when the automatic set-up procedure is invoked by a trained service representative using a special key or code, the system will go into a special mode (step 80). Now, the service representative or operator will be prompted to put the special set-up target document on the platen and to push the START button (step 82). Pressing START will cause the machine to store the original set of process control parameters (step 84) and run the procedure automatically, stopping after "n" iterations set at step 86. The number of iterations generally needed for a particular machine design can be determined by experience during development or as the machines age.

During the first iteration, the target document is imaged onto three frames of photoconductive belt 18 in the track of on-line densitometer 76. Each frame is toned with a different color toner, and the resultant densities are read (step 88) and compared to the set of density aim values stored during the calibration procedure (step 90). Detectable errors between the density values attained and the aim values are used to determine a new set of process control parameters (Step 92).

The process is repeated "n" times. During the last iteration, as determined by Step 94, a determination is made as to whether the process is being run by a customer operator or by a trained service representative (Step 96). If the latter, a receiver sheet is fed from a supply to receive the three color separations for the representative's review (Step 98).

When the set-up procedure is completed, the operator will be prompted to store the new set of process control parameters, revert to the original set which was in effect before the set-up process was started, or to revert to a factory-determined default set of parameters.

In accordance with the above disclosure, the present invention provides for field adjustments of the values of the aim points. The operator is given the option to revert to the original or a default set-up if desired. Trained service representatives may produce prints of the toned patches while conserving consumables by delaying the print until all iterations are finished.

The invention has been described in detail with particular reference to preferred embodiments thereof, but it will be understood that variations and modifications can be effected within the spirit and scope of the invention.

What is claimed is:

1. Apparatus for adjusting process control parameters in an electrostatographic machine, said apparatus comprising:

calibration means for enabling field adjustment of process control parameters until a visually desirable image is attained, and for storing toner test patch densities according to the field-adjusted process control parameters for later use as aim values; and an automatic set-up device including means for recording a series of set-up toner density patches corresponding to the stored toner test patch densities, means for detecting the density of the recorded set-up toner density patches, and means for setting process control parameters in accordance with differences between the densities of the recorded patches and the corresponding aim values.

2. Apparatus as defined in claim 1 wherein said automatic set-up device further includes means for transferring the series of recorded set-up toner density patches to a copy sheet for viewing by an operator.

3. Apparatus as defined in claim 1 wherein said automatic set-up device further includes means for:

resetting the process control parameters by producing at least a second series of set-up toner density patches after the process control parameters have been set in accordance with differences between the first recorded densities and the aim values, detecting the density of each density patch of the second set, and resetting process control parameters in accordance with differences between the densities of the recorded patch of the at least second set and the aim densities.

4. Apparatus as defined in claim 1 wherein said automatic set-up device further includes means for transferring the series of recorded set-up toner density patches to a copy sheet for viewing by an operator, said transferring means being effective only after the last resetting of the process control parameters.

5. Apparatus for adjusting process control parameters in an electrostatographic machine, said apparatus comprising.

calibration means for field adjusting process control parameters until a visually desirable image is attained, and for storing toner test patch density aim values according to the field-adjusted process control parameters;

an automatic set-up device including means for recording a series of set-up toner density patches corresponding to the stored toner test patch densities, means for detecting the density of the recorded set-up toner density patches, and means for setting process control parameters in accordance with differences between the densities of the recorded patches and the corresponding aim values; and means having a first mode for transferring the series of recorded set-up toner density patches to a copy sheet for viewing by an operator and a second mode wherein the series of recorded set-up toner density patches are not transfered to a copy sheet.

6. Apparatus for adjusting process control parameters in an electrostatographic machine, said apparatus comprising:

memory means for recording a preliminary set of process control parameters;

calibration means for field adjusting process control parameters until a visually desirable image is attained, and for storing toner test patch density aim values according to the field-adjusted process control parameters;

an automatic set-up device including means for recording a series of set-up toner density patches corresponding to the stored toner test patch density aim values, means for detecting the density of each set-up toner density patch, and means for setting process control parameters in accordance with differences between the densities of the recorded patches and the corresponding density aim values; and operator selectable means selectively for reverting to said preliminary set of process control parameters.

7. Apparatus as defined in claim 6 wherein said memory means is adapted to record a factory programmed default set of process control parameters.

8. Apparatus as defined in claim 6 wherein said memory means is adapted to record a user predetermined set of process control parameters.

9. Apparatus for adjusting process control parameters in a color electrostatographic machine, said apparatus comprising.

calibration means for enabling field adjustment of process control parameters until a visually desirable color image is attained, and for storing color separation toner test patch densities according to the field-adjusted process control parameters for each of a plurality of color separations for later use as aim values; and an automatic set-up device including means for recording a series of set-up toner density patches for each of the plurality of color separations corresponding to the stored toner test patch densities, means for detecting the density of the recorded set-up toner density patches, and means for setting process control parameters in accordance with differences between the densities of the recorded patches and the corresponding aim values.

10. Apparatus as defined in claim 9 wherein said automatic set-up device further includes means for transferring the series of recorded set-up toner density patches to a single copy sheet to create a plurality of gray scale patches forming a step tablet for viewing by an operator.

11. Apparatus as defined in claim 9 wherein said automatic set-up device further includes means for resetting the process control parameters by recording at least a second series of set-up toner density patches for each of the plurality of color separations after the process control parameters have been set in accordance with differences between the first recorded densities and the aim values, detecting the density of each density patch of the second set, and resetting process control parameters in accordance with differences between the densities of the recorded patch of the at least second set and the aim densities.

12. Apparatus as defined in claim 9 wherein said automatic set-up device further includes means for transferring the series of recorded set-up toner density patches to a single copy sheet to create a plurality of gray scale patches forming a step tablet for viewing by an operator, said transferring means being effective only after the last resetting of the process control parameters.

13. Apparatus for adjusting process control parameters in a color electrostatographic machine, said apparatus comprising:

calibration means for field adjusting process control parameters until a visually desirable color image is attained, and for storing color separation toner test patch density aim values according to the field-adjusted process control parameters for each of a plurality of color separations;

an automatic set-up device including means for recording a series of set-up toner density patches for each of the plurality of color separations corresponding to the stored toner test patch densities, means for detecting the density of the recorded set-up toner density patches, and means for setting process control parameters in accordance with differences between the densities of the recorded patches and the corresponding aim values; and means having a first mode for transferring the series of recorded set-up toner density patches to a single copy sheet to create a plurality of gray scale patches forming a step tablet for viewing by an operator and a second mode wherein the series of recorded set-up toner density patches are not transfered to a copy sheet.

14. Apparatus for adjusting process control parameters in a color electrostatographic machine, said apparatus comprising:

memory means for recording a preliminary set of process control parameters for each of a plurality of color separations;

calibration means for field adjusting process control parameters until a visually desirable color image is attained, and for storing toner test patch density aim values for each of a plurality of color separations according to the field-adjusted process control parameters;

an automatic set-up device including means for recording a series of set-up toner density patches for each of the plurality of color separations corresponding to the stored toner test patch density aim values, means for detecting the density of each set-up toner density patch, and means for setting process control parameters in accordance with differences between the densities of the recorded patches and the corresponding density aim values; and operator selectable means selectively for reverting to said preliminary set of process control parameters.

15. Apparatus as defined in claim 14 wherein said memory means is adapted to record a factory programmed default set of process control parameters.

16. Apparatus as defined in claim 14 wherein said memory means is adapted to record a user predetermined set of process control parameters.

17. In a color image reproduction device, apparatus for automatically adjusting process control parameters to achieve quality color reproductions, said apparatus comprising:

means for producing a plurality of color separations on a recording member;

calibration means for enabling field adjustment of process control parameters to achieve quality color reproductions and for storing a plurality of color separation density measurements across a range of densities for each color separation according to the field-adjusted parameters;

automatic set-up apparatus including means for making a plurality of color separation set-up density measurements corresponding to the stored density measurements, computing means for calculating a set of error signals in accordance with differences between the stored density measurements and the corresponding set-up density measurements, and means responsive to said set of error signals for calculating a set of process control parameter adjustment signals to minimize said error signals.

18. A process for adjusting process control parameters in an electrostatographic machine comprising:

field adjusting process control parameters to achieve quality color reproductions;

storing a plurality of color separation density measurements across a range of densities for each color separation according to the field-adjusted parameters;

imaging a target document onto a plurality of image frames of a photosensitive recording member to create a corresponding number of toned color separations;

toning each frame with a corresponding color toner;

calculating a set of error signals in accordance with differences between the stored density measurements and the corresponding set-up density measurements; and adjusting the process control parameters according to the set of error signals.

19. A process for adjusting process control parameters in an electrostatographic machine comprising the steps of:

field adjusting process control parameters until a visually desirable image is attained;

storing toner test patch densities according to the field-adjusted process control parameters for later use as aim values;

recording a series of set-up toner density patches corresponding to the stored toner test patch densities;

detecting the density of the recorded set-up toner density patches; and setting process control parameters in accordance with differences between the densities of the recorded patches and the corresponding aim values.

20. A process as defined in claim 19 further comprising the step of transferring the series of recorded set-up toner density patches to a copy sheet for viewing by an operator.

21. A process as defined in claim 19 further comprising:

resetting the process control parameters by producing at least a second series of set-up toner density patches after the process control parameters have been set in accordance with differences between the first recorded densities and the aim values;

detecting the density of each density patch of the second set; and resetting process control parameters in accordance with differences between the densities of the recorded patch of the at least second set and the aim densities.

22. A process as defined in claim 19 further comprising:

transferring the series of recorded set-up toner density patches to a copy sheet only after the last resetting of the process control parameters for viewing by an operator.

23. A process as defined in claim 19 further comprising selectively reverting to said aim set of process control parameters.

24. A process as defined in claim 19 further comprising selectively reverting to a factory programmed default set of process control parameters.

* * * * *